United States Patent [19]

Allen

[11] Patent Number: 4,750,500

[45] Date of Patent: Jun. 14, 1988

[54] DEVICE FOR FACILITATING HAIR STYLING USING PLURAL TINTS

[76] Inventor: Jerilyn Allen, 4644 Adams Dr., Concord, Calif. 94521

[21] Appl. No.: 903,338

[22] Filed: Sep. 3, 1986

[51] Int. Cl.[4] ..... A45D 1/00; A45D 7/00

[52] U.S. Cl. ..... 132/9; 132/7; 132/38 R; 132/46 R

[58] Field of Search ..... 132/7, 9, 38 R, 36, 132/39, 46 R; 34/96, 99, 101, 3; 2/171, 174, 185 R, 186 R, 197, 198, 199, 209.2

[56] References Cited

U.S. PATENT DOCUMENTS

| | | | |
|---|---|---|---|
| 1,995,369 | 3/1935 | Thiemen | 132/38 R |
| 2,125,622 | 8/1938 | Bleuel et al. | 132/36 |
| 2,575,589 | 11/1951 | Glick | 132/7 |
| 2,818,074 | 12/1957 | Mach | 132/9 |
| 2,903,001 | 9/1959 | Lowe | 132/39 |
| 3,019,797 | 2/1962 | Strys et al. | 132/46 R |
| 3,304,945 | 2/1967 | Anderson | 132/9 |
| 3,315,688 | 4/1967 | Sbarra | 132/9 |
| 3,444,864 | 5/1969 | Glushakow | 132/38 |
| 3,543,770 | 12/1970 | Snider | 132/7 |
| 3,690,330 | 9/1972 | Grismen | 132/46 |
| 3,786,819 | 1/1974 | Cantrell | 132/9 |
| 4,398,549 | 8/1983 | Thomas | 132/9 |

FOREIGN PATENT DOCUMENTS

| | | | |
|---|---|---|---|
| 2405638 | 2/1975 | Fed. Rep. of Germany | 132/9 |

*Primary Examiner*—Robert P. Swiatek
*Assistant Examiner*—James R. Hakomaki
*Attorney, Agent, or Firm*—Townsend and Townsend

[57] ABSTRACT

A device for use in applying two or more bleaches, tints, mousses, or other coloring agents to the hair. The device facilitates uniform application of multiple tints without the tints bleeding into one another.

17 Claims, 1 Drawing Sheet

DEVICE FOR FACILITATING HAIR STYLING USING PLURAL TINTS

BACKGROUND OF THE INVENTION

This invention relates to hair styling and, more particularly, to hair coloring. Specifically, the invention is directed to a device for use in connection with tinting hair with substances for providing two or more colors or shades of color.

The known frosting cap includes a pierceable liner within a hood having rows of holes. A hooked implement is manually inserted through a hole, pierces the liner, and captures a few strands of hair, which are then manually pulled through the punctured liner and the hole in the hood. A single color is then applied to the hair. The frosting cap is intended for applying only one color. The frosting cap is not suitable for tinting hair with more than one color because the colors would bleed. Therefore, a frosting cap is not used when plural tints are applied.

Nevertheless, it is known to apply several tints in hair styling. If various tints are to be applied to the hair, one or more adjacent groups of strands of hair are colored or bleached and then manually rolled in foil in order to prevent bleeding of colors to adjacent groups of strands of hair to which another tint is applied. However, individually coloring and manually rolling locks of hair in foil is time-consuming and leads to undesirable color variations due to lack of uniformity in the time that the hair color mixture or bleach contacts the hair.

SUMMARY OF THE INVENTION

This invention provides a device for facilitating hair styling using plural tints. The device comprises a hood having a pierceable liner, which is placed on the head of a person. Preferably, holes or circular scores appear in rows on the hood to indicate locations where a hooked implement is manually insertable through the hood for puncturing the liner so as to snare locks of hair. The device further comprises translucent flaps integral with or affixed to the hood between predetermined rows of the holes or circular scores. The flaps can be of different widths to accommodate different lengths of hair. The hooked implement is inserted between the flaps through the holes or scored areas and is used to puncture the liner, snare locks of hair, and pull the locks of hair through the liner and the hood. The flaps separate the layers of hair, which are formed when the individual locks are pulled through the hood. Dye or bleach can then be applied to each layer of hair. Different hair colors or a combination of color and bleach can be readily applied to the different layers of hair for producing multiple tints. The flaps separate the layers of hair so that the color or bleach does not bleed on adjacent layers. Furthermore, the flaps retain the heat produced in connection with the tinting process, thereby obviating the need for an additional plastic shroud, or over cap, typically applied to the head for the purpose of heat retention.

The device in accordance with the invention provides flaps to avoid having to wrap the colored or bleached hair in foil in order to prevent bleeding of colors. Hair between the flaps can be effectively colored with the desired color or can be bleached. The flaps prevent bleeding of colors or bleach when various tints are applied to the hair. Furthermore, the flaps can be of different widths to accommodate different lengths of hair. The flaps enable hair color and/or bleach to be applied uniformly and quickly to an entire layer of hair so that hair color variations and waste of hair color mixture are avoided.

BRIEF DESCRIPTION OF THE DRAWINGS

The above and other features of the invention and the concomitant advantages will be better understood and appreciated by those skilled in the art in view of the description of the preferred embodiments given below in conjunction with the accompanying drawings. In the drawings.

DETAILED DESCRIPTION OF THE PREFERRED EMBODIMENTS

This invention provides a device for facilitating hair styling using plural tints. This is in contrast to the known frosting cap which is intended for only one color. Furthermore, unlike individually coloring and rolling locks of hair in foil, the device in accordance with the invention facilitates hair styling using plural tints. Moreover, the device enables uniform application of color and/or bleach and avoids variations in hair colors experienced when the time-consuming process of individually coloring and rolling locks of hair in foil is used.

Figure 1:
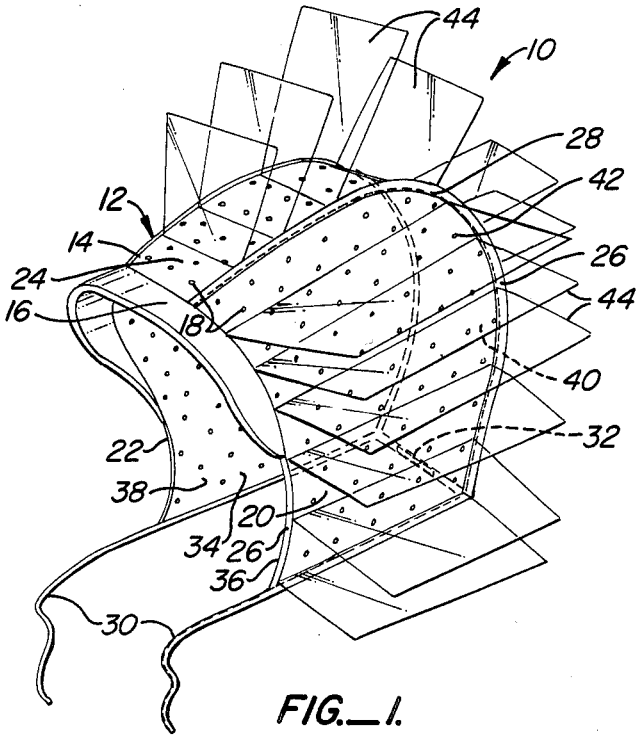
FIG. 1 is an isometric view of the device in accordance with the invention for use in tinting hair for providing multiple colors or shades of color.
Figure 2:
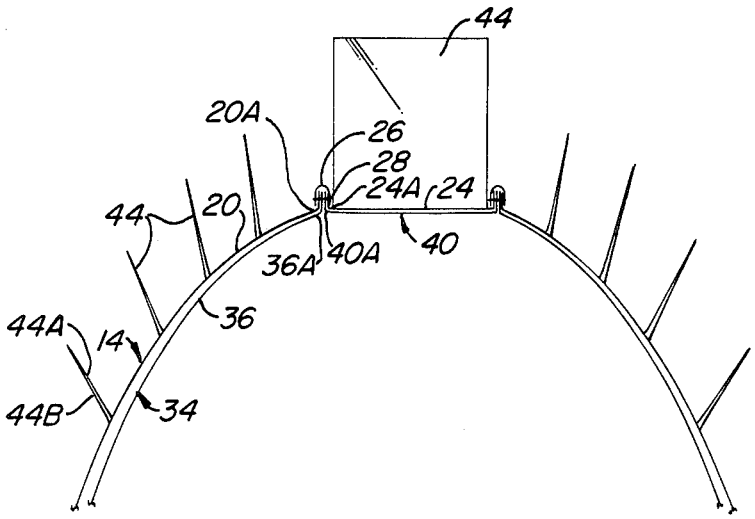
FIG. 2 is a cross-sectional view of a portion of the device shown in FIG. 1.

With reference to FIG. 1, the device in accordance with the invention for facilitating hair styling using plural colors is generally designated by the numeral 10. The device 10 comprises a hood 12 adapted to be placed on the head of a person. As shown in FIGS. 1 and 2, the hood 12 includes a cap 14. The hood 12 preferably includes a bill 16 for diverting color or bleach applied to the hair from flowing onto the person's face. The bill 16 can be formed integrally with the cap 14 or can be a separate element affixed to the cap. The cap 14 also includes holes or circular scores 18, as will be described in more detail shortly. The cap 14 preferably consists of a vinyl plastic material similar to the material used in the fabrication of the cap included in the Model 200 Disposable Frosting/Tipping Cap Kit manufactured by Conair Corporation, Edison, N.J. 08817.

Preferably, the cap 14 comprises a plurality of panels, including two side panels 20 and 22 and a crown panel 24 intermediate the two side panels. The panels 20, 22, and 24 are preferably aligned and overlapped along adjoining edges, the edges are sandwiched within piping 26, and the edges and the piping are sewn, as indicated by the stitches 28 shown in FIG. 1. For example, as shown in FIG. 2, an edge 20A of the side panel 20 is slightly overlapped with an edge 24A of the crown panel 24. The piping 26 is then folded over the overlapped edges 20A and 24A. The stitches 28 fix the overlapped edges 20A and 24A and the piping 26 together.

Extra piping 26 can be provided for the purpose of providing a chin tie 30 which can be tied for retaining the hood 12 on the person's head. Additionally, a stretched elastic strip 32 can be sewn within the piping 26 at the base of the crown panel 24 so as to form an expandable gather for the purpose of snugging the base of the hood 12 against the back of the person's neck when the chin tie 30 is tied.

Alternatively, the panels 20, 22, and 24 can be heat-seam-welded along their adjoining edges, the chin tie 30 can be separate elements heat-seam-welded to the cap 14, and the stretched elastic strip 32 can be sewn directly to the base of the crown panel 24. The bill 16 can be fabricated from the same material as and sewn to the cap 14, as in the case of the cap included in the Conair Model 200 kit, or alternatively heat-seam-welded to the cap.

The hood 12 also includes a liner 34, as shown in FIGS. 1 and 2. The liner 34 preferably comprises side panels 36 and 38 and a crown panel 40 parallel to the respective side panels 20, 22, and 24 of the cap 14 and similarly joined along adjoining edges. For instance, edges 36A and 40A of the panels 36 and 40 of the liner 34 are overlapped and sewn or heat-seam-welded within the piping 26 interior of the edges 20A and 24A of the panels 20 and 24 of the cap 14, as shown in FIG. 2. The liner 34 preferably consists of a clear plastic material similar to the material used in the fabrication of the liner included in the Conair Model 200 kit.

Preferably, the holes or circular scores 18 appear in rows 42 on the cap 14 to indicate locations where a hooked implement (not shown) is manually insertable through the holes or circular scores in the cap for puncturing the liner 34 so as to snare locks of hair. The rows 42 of the holes or circular scores 18 can be spaced vertically approximately three-eighths of an inch apart, adjacent holes or circular scores in each row being spaced approximately three-quarters of an inch apart, and the holes or circular scores in odd-numbered rows being horizontally offset approximately three-eighths of an inch from the holes or circular scores in even-numbered rows, for example.

The device 10 further comprises flaps 44 projecting from the hood 12 between predetermined rows of the holes or circular scores 18. Preferably, the flaps 44 are disposed so that two rows 42 of the holes or circular scores 18 appear between adjacent flaps. The flaps 44 are preferably translucent so that hair between adjacent flaps is visible. Preferably, the flaps 44 are clear so that color development, which results from contact of the hair color mixture and/or bleach with the hair, can be continuously and easily monitored. The flaps 44 can be of a uniform width or can be of different widths to accommodate different lengths of hair.

The flaps 44 can be formed as folds or pleats in the material from which the cap 14 is fabricated. The pleats are then sewn or heat-seam-welded in the vicinity contiguous with the cap 14 so that the configuration of the flaps is maintained. For example, as shown in FIG. 2, the flaps 44 are formed as pleats having sides 44A and 44B extending away from the surface of the cap 14. The sides 44A and 44B are sewn or heat-seam-welded where they intersect the surface of the cap 14.

Alternatively, the flaps 44 can comprise individual sheets affixed to the cap 14 between the rows 42 of the holes or circular scores 18. The flaps 44 in the form of sheets can consist of a plastic material similar to the material of which the liner 34 is fabricated.

In use, the hooked implement (not shown) is manually inserted between the flaps 44 through one of the holes or circular scores 18 and is used to puncture the liner 34, snare a lock of hair, and pull the lock of hair through the liner and the cap 14. This procedure is repeated until the desired amount of hair to be colored forms a layer between the flaps 44.

The flaps 44 separate the layers of hair which are formed when the individual locks are pulled through the hood 12. Dye or bleach can then be applied to each layer of hair. Different hair colors or a combination of color and bleach can be applied to the different layers of hair for producing multiple tints. The flaps 44 separate the layers of hair so that the color or bleach does not bleed on adjacent layers.

The device 10 in accordance with the invention enables many different colors and/or bleach to be applied to the hair at one sitting. The flaps 44 eliminate having to wrap the colored or bleached hair in foil in order to prevent bleeding of colors. The use of the device 10 in accordance with the invention saves one-fourth to one-half the length of time typically required for individually coloring and rolling locks of hair in foil and eliminates messy foil packets.

The flaps 44 prevent bleeding of colors or bleach when various tints are applied to the hair. Furthermore, the flaps 44 can be a uniform width, or they can be of different widths to accommodate different lengths of hair. The flaps enable hair color and/or bleach to be applied evenly and quickly to an entire layer of hair, so that hair color variations and waste of hair color mixture are avoided, and retain heat.

The foregoing description is offered primarily for purposes of illustration. While various specific embodiments have been disclosed, it will be readily apparent to those skilled in the art that numerous modifications and variations not mentioned above can be made without departing from the spirit and scope of the invention as claimed below.

What is claimed is:

1. In a hair styling device for facilitating application of a plurality of tints of various coloring, including:

a lined hood adapted to be fitted on the head of a person and having horizontal rows of holes adapted to receive a hooked implement for drawing quantities of said person's hair through the lined hood for selective tint application, the improvement comprising a plurality of horizontal flaps extending around said hood;

said flaps being attached to said hood at vertical intervals spaced by at least one of said horizontal rows of holes;

each of said flaps serving to provide a protective cover for hair quantities extending through at least one of said horizontal rows, to prevent bleeding of tints from one horizontal row to another when multiple tints are sequentially applied to designated of said rows.

2. The device according to claim 1 wherein the flaps are translucent.

3. The device according to claim 1 wherein the flaps have different widths, whereby different lengths of hair can be tinted.

4. The device according to claim 1 wherein the cap comprises a plurality of panels having edges, wherein adjoining edges of the panels are overlapped, sandwiched within piping, and bound together with the piping.

5. The device according to claim 4 wherein the overlapped edges of the panels of the cap and the piping are stitched together.

6. The device according to claim 4 wherein the overlapped edges of the panels of the cap and the piping are heat-seam-welded together.

7. The device according to claim 4 wherein the liner comprises a plurality of panels having edges, wherein adjoining edges of the panels are overlapped, sandwiched within the piping interior of the edges of the panels of the cap, and bound together with the edges of the panels of the cap and the piping.

8. The device according to claim 7 wherein the overlapped edges of the panels of the cap, the overlapped edges of the panels of the liner, and the piping are stitched together.

9. The device according to claim 7 wherein the overlapped edges of the panels of the cap, the overlapped edges of the panels of the liner, and the piping are heat-seam-welded together.

10. The device according to claim 1, further comprising a chin tie affixed to the hood for retaining the hood on the person's head.

11. The device according to claim 4 wherein the piping is extended for providing a chin tie for retaining the hood on the person's head.

12. The device according to claim 7 wherein the piping is extended for providing a chin tie for retaining the hood on the person's head.

13. The device according to claim 1 wherein the flaps comprise pleats formed in the cap, sides of the pleats being joined together where the sides of the pleats intersect the cap.

14. The device according to claim 1 wherein the flaps comprise individual sheets affixed to the cap.

15. A device for facilitating hair styling using plural tints, comprising in combination:

a hood adapted to be fitted on the head of a person, the hood comprising:

(a) a cap having rows of holes, the cap including a plurality of panels having edges, adjoining edges of the panels of the cap being overlapped and sandwiched within piping; and (b) a pierceable liner, the liner including a plurality of panels having edges, adjoining edges of the panels of the liner being overlapped and sandwiched within the piping interior of the edges of the panels of the cap;

the edges of the panels of the cap and of the liner and the piping being bound together; and a plurality of translucent flaps on the cap having preselected widths, the flaps being interposed between predetermined rows of holes and spaced apart so as to enable a hooked implement to be manually inserted between the flaps through the holes in the cap for puncturing the liner and snaring and pulling locks of hair on the person's head through the liner and the cap to be selectively colored and bleached;

whereby the flaps separate the colored layers of hair in order to prevent bleeding of colors so that multiple tints can be effectively applied to the hair.

16. The device according to claim 15 wherein the flaps comprise pleats formed in the cap, sides of the pleats being joined together where the sides of the pleats intersect the cap.

17. The device according to claim 15 wherein the flaps comprise individual sheets affixed to the cap.

* * * * *